US007871749B2

(12) United States Patent
Choi et al.

(10) Patent No.: US 7,871,749 B2
(45) Date of Patent: Jan. 18, 2011

(54) ELECTROPHOTOGRAPHIC DEVELOPING AGENT

(75) Inventors: Seok-hoon Choi, Suwon-si (KR); Sang-deok Kim, Gwangmyeong-si (KR); Duck-hee Lee, Seoul (KR); Ki-won Seok, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 872 days.

(21) Appl. No.: 11/798,564

(22) Filed: May 15, 2007

(65) Prior Publication Data

US 2008/0153022 A1 Jun. 26, 2008

(30) Foreign Application Priority Data

Dec. 21, 2006 (KR) ..... 10-2006-0132020

(51) Int. Cl.
*G03G 9/00* (2006.01)

(52) U.S. Cl. ..... 430/109.4; 430/110.1; 430/108.1; 430/108.7; 399/252

(58) Field of Classification Search ..... 430/109.4, 430/110.1, 108.1, 108.7; 399/252
See application file for complete search history.

(56) References Cited

U.S. PATENT DOCUMENTS

| | | | | |
|---|---|---|---|---|
| 5,156,937 | A * | 10/1992 | Alexandrovich et al. | 430/109.4 |
| 2002/0051923 | A1 * | 5/2002 | Takayanagi et al. | 430/108.4 |
| 2005/0208403 | A1 * | 9/2005 | Shu et al. | 430/108.1 |
| 2006/0057487 | A1 * | 3/2006 | Nagayama et al. | 430/109.4 |

* cited by examiner

*Primary Examiner*—Mark A Chapman
(74) *Attorney, Agent, or Firm*—Roylance, Abrams, Berdo & Goodman, L.L.P.

(57) ABSTRACT

A non-magnetic one-component electrophotographic developing agent is provided having improved properties. The electrophotographic developing agent includes parent toner particles comprising a binder resin, a releasing agent, a colorant, and a charge control agent, and an external additive which is added to a surface of the parent toner particles, wherein the binder resin comprises a high viscosity polyester resin having a weight average molecular weight of about 90,000-140,000 and a gel content of less than about 5% and a low viscosity polyester resin having a weight average molecular weight of about 52,000-65,000 and a gel content of less than about 2%. According to an embodiment of the present invention, an electrophotographic developing agent having improved image gloss and fusing property, while ensuring durability may be prepared by using a blended combination of a high viscosity polyester resin and a low viscosity polyester resin.

17 Claims, 2 Drawing Sheets

ELECTROPHOTOGRAPHIC DEVELOPING AGENT

CROSS-REFERENCE TO RELATED PATENT APPLICATION

This application claims the benefit of Korean Patent Application No. 10-2006-0132020, filed on Dec. 21, 2006, in the Korean Intellectual Property Office, the disclosure of which is hereby incorporated by reference in its entirety.

BACKGROUND OF THE INVENTION

1. Field of the Invention

The present invention relates to an electrophotographic developing agent. More particularly, the invention relates to an electrophotographic developing agent having improved fusing property and image gloss, etc. while ensuring durability by combining a high viscosity polyester resin with a low viscosity polyester resin.

2. Description of the Related Art

Electrophotographic image processing apparatuses, such as laser printers, facsimiles, copying machines, and the like are now widely used. The apparatuses form desired images by forming latent images on a photoreceptor by utilizing a laser, transferring a toner to the latent images on the photoreceptor using an electrical potential difference, and then transferring the images to a printing media such as paper.

Recently, image forming apparatuses, such as laser beam printers (LBPs) for electrophotographs, multifunction machines, color copying machines, and the like are widely used and there is a need to increase image qualities of the apparatuses. Color laser printers realize various colors using four basic color toners (cyan, magenta, yellow, and black), unlike mono-color laser printers. For example, magenta and yellow are used together to realize a red color. Thus, color laser printers form thicker image toner layers than mono-color laser printers. Color printers need a higher fusing property than mono laser printers to maintain a fusing property of the thicker toner layers on the toner images.

There is a great need for double-sided print to reduce an amount of paper used in view of environmental problems and to meet users' needs. Double-sided print has a greater risk of contamination of back sides due to hot offset and a greater risk of serious wrap jamming of a fusing unit, than one-sided print. In order to solve these problems, releasing agents are kneaded and dispersed into toners. However, there are many difficulties in selecting suitable kneading conditions and types of the releasing agents.

In case of mono-color prints, non-gloss prints are preferred to prevent fatigue of eyes due to dazzle and to facilitate copying. However, as expectations for graphics and real picture print increases according to colorization, there is an increasing need for high gloss prints such as photographs.

In many toners having a high gloss, the durability and image qualities deteriorate as the time of use increases. Many trials have been conducted to overcome these problems.

SUMMARY OF THE INVENTION

The present invention provides an electrophotographic developing agent having improved fusing property and image gloss, while ensuring the durability of images overlapped due to colorization.

The present invention also provides an electrophotographic image forming apparatus using the above electrophotographic developing agent.

According to an aspect of the present invention, a non-magnetic one-component electrophotographic developing agent is provided comprising: parent toner particles comprising a binder resin, a releasing agent, a colorant, and a charge control agent; and an external additive which is added to a surface of the parent toner particles, wherein the binder resin comprises a high viscosity polyester resin having a weight average molecular weight of about 90,000-140,000 and a gel content of less than about 5% and a low viscosity polyester resin having a weight average molecular weight of about 52,000-65,000 and a gel content of less than about 2%.

According to another aspect of the present invention, an electrophotographic image forming apparatus is provided using the electrophotographic developing agent.

Thus, an electrophotographic developing agent is provided having improved fusing property and image gloss, while ensuring durability of the developing agent.

These and other aspects of the invention will become apparent from the annexed figures and the following detailed description of the invention which disclose various embodiments of the invention.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
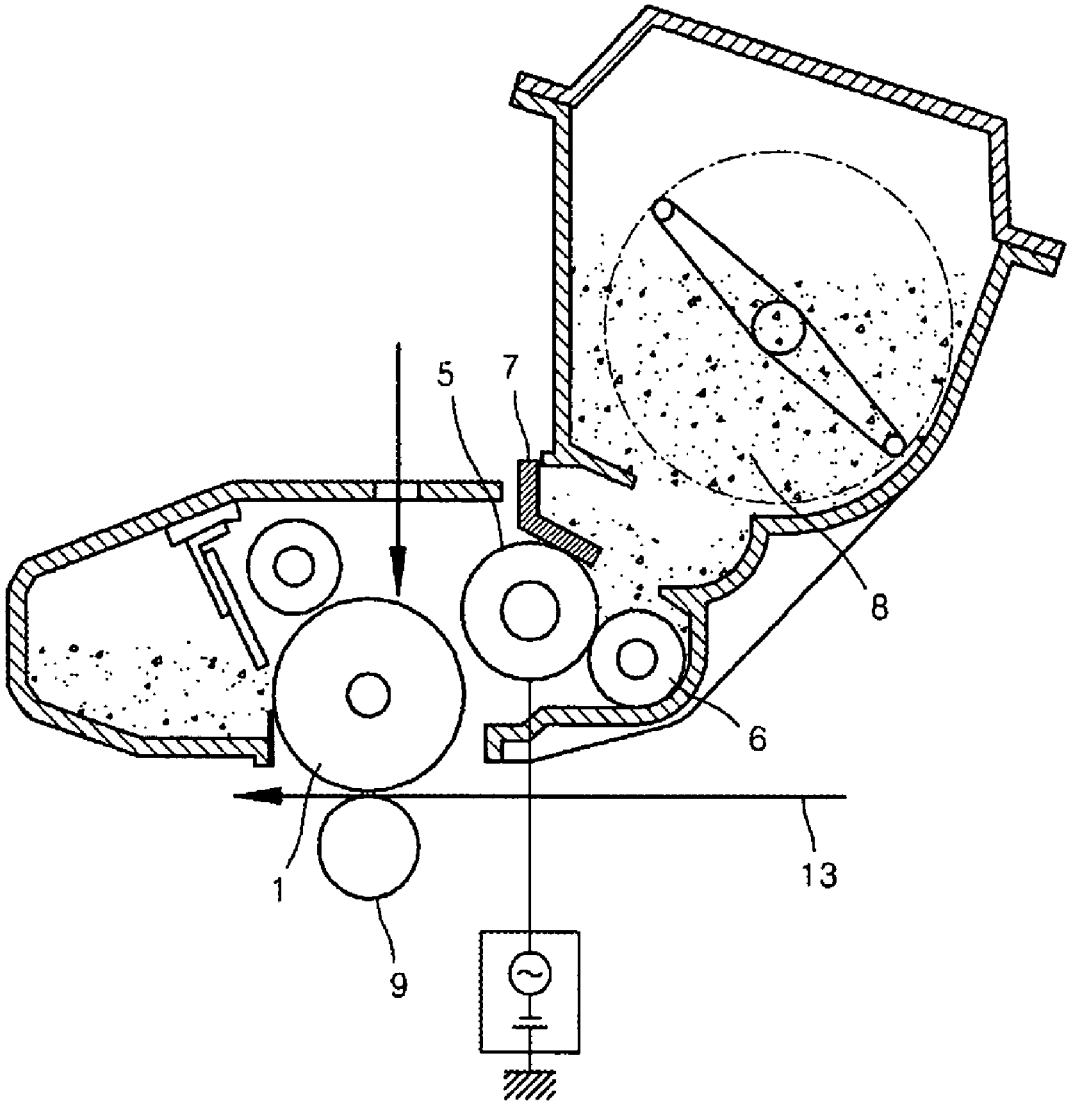
FIG. 1 is a schematic view illustrating an electrophotographic apparatus using a non-contacting developing mode according to an embodiment of the present invention.

Hereinafter, the present invention will be described in detail by explaining embodiments of the invention with reference to the attached drawings. It will be understood that the following description is intended to be exemplary of the various features of the invention and that other modifications can be made within the scope of the invention.

In an embodiment of the present invention, in order to increase the fusing property, gloss, and durability of an electrophotographic developing agent, a blend of a high viscosity polyester resin and a low viscosity polyester resin is used as the binder resin used to form the toner particle of developing agent. The polyester resins used for the binder resins are commercially available resin and are blended or mixed based on the viscosity of the respective polyester resin. The viscosity of the polyester resins according to the invention are based primarily of the weight average molecular weigh, the number average molecular weight, that glass transition temperature, the polydispersion index, the acid value, and gel content of the polyester resins as discussed hereinafter in greater detail. Examples of suitable high and low viscosity polyester resins are available from Mitsubishi Rayon Co. Ltd.

Various known resins may be used as the binder resins. Examples of binder resin include a styrene based copolymer such as polystyrene, poly-p-chlorostyrene, poly-α-methylstyrene, styrene-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-propyl acrylate copolymer, styrene-butyl acrylate copolymer, styrene-octyl acrylate copolymer, styrene-methyl methacrylate copolymer, styrene-ethyl methacrylate copolymer, styrene-propyl methacrylate copolymer, styrene-butyl methacrylate copolymer, styrene-α-chloromethylmethacrylate copolymer, styrene-acrylonitrile copolymer, styrene-vinylmethylether copolymer, styrene-vinylethylether copolymer, styrene-vinylethylketone copolymer, styrene-butadiene copolymer, styrene-acrylonitrile-indene copolymer, styrene-maleic acid copolymer, and styrene-maleic ester. Other binder resins include polymethylmethacrylate, polyethylmethacrylate, polybutylmethacrylate, and a copolymer thereof, polyvinyl chloride, polyvinyl acetate, polyethylene, polypropylene, polyester, polyurethane, polyamide, epoxy resin, polyvinylbutyral resin, rosin, modified rosin, terpene resin, phenolic resin, aliphatic or alicyclic hydrocarbon resin, aromatic petroleum resin, chlorinated paraffin and paraffin wax, etc, or a mixture thereof. Among these resins, polyester resins have an excellent fusing property and transparency and is suitably used in a color developing agent. In one embodiment of the invention the binder resin consists essentially of a blend of a high viscosity polyester resins and a low viscosity polyester resin. The high viscosity polyester resin preferably has a higher weight average molecular weight, a high gel content, a higher acid value and a higher glass transition temperature compared to the values for the low viscosity polyester resin.

The high viscosity polyester resin has a weight average molecular weight of about 90,000-140,000 and a gel content of less than about 5% and the low viscosity polyester resin has a weight average molecular weight of about 52,000-65,000 and a gel content of less than about 2%.

The gel content is related to the melt flowability of toner particles. If the gel content of the high viscosity polyester resin is 5% or greater or the gel content of the low viscosity polyester resin is 2% or greater, the flowability of toner particles decreases and flatness of surfaces decreases, and thus surface smoothness may decrease and diffused reflection may easily occur.

The high viscosity polyester resin may have an acid value of about 10-20 mg KOH/g and the low viscosity polyester resin may have an acid value of about 5-15 mg KOH/g.

The concentration of the high viscosity polyester resin may be about 10-60% by weight and the concentration of the low viscosity polyester resin may be about 40-90% by weight based on the weight of the binder resin. If the concentration of the high viscosity polyester resin is less than about 10% by weight, durability of the toner decreases, thereby decreasing the image density of the toner over time. If the concentration of the high viscosity polyester resin is greater than about 60% by weight, the fusing property of the toner remarkably decreases.

The high viscosity polyester resin may have a glass transition temperature ($T_g$) of about 63-65° C. and the low viscosity polyester resin may have a glass transition temperature ($T_g$) of about 61-63° C.

The high viscosity polyester resin may have a number average molecular weight of about 2,800-3,000 and the low viscosity polyester resin may have a number average molecular weight of about 3,600-3,800.

The high viscosity polyester resin may have a polydispersion index ($M_w/M_m$) of about 36-43 and the low viscosity polyester resin may have a polydispersion index ($M_w/M_m$) of about 15-25.

The electrophotographic developing agent according to an embodiment of the present invention comprises a releasing agent. Examples of the releasing agent include a polypropylene wax, a polyethylene wax, an ester wax, a paraffin wax, a carnauba wax (a natural wax), and the like. Other suitable releasing agents can also be used as known in the art.

The releasing agent can be a polypropylene wax having a melting point of about 135-145° C. and a weight average molecular weight ($M_w$) of about 3000-11000. The polyethylene wax may have a melting point of about 100-120° C. and a weight average molecular weight ($M_w$) of about 2000-8000. The ester wax used as the releasing agent may have a melting point of about 70-85° C. The paraffin wax used as the releasing agent may have a melting point of about 80-100° C. and a weight average molecular weight ($M_w$) of about 500-1000. The carnauba wax used as the releasing agent may have a melting point of about 80-90° C.

The natural wax (carnauba wax) having a melting point of about 80-90° C. may be used as the releasing agent where the concentration of the natural wax may be about 2-5% by weight based on the weight of the parent toner particles. If the melting point of the wax is less than 80° C. or greater than 90° C., a difference of melt flowability between the wax and the binder resin is too great and thus, due to a great difference of viscosity between them, the wax cannot be easily dispersed in the binder resin. The carnauba wax is compatible with a polyester binder, and thus, has a high dispersion in the polyester binder.

The electrophotographic developing agent according to an embodiment of the present invention comprises a colorant. A black toner may comprise carbon black or aniline black as the colorant. The non-magnetic toner according to an embodiment of the present invention may be useful in preparing a color toner. For the color toner, carbon black is used to realize black color, and yellow, magenta, and cyan colorants are used to realize chromatic colors.

Examples of the yellow colorant include a condensed nitrogen compound, an isoindolinone compound, an anthraquinone compound, an azo-metal complex, or an allyl imide compound. For example, C.I. Pigment Yellow (PY) 12, 13, 14, 17, 62, 74, 83, 93, 94, 95, 109, 110, 111, 128, 129, 147, 168, 180, and others maybe used.

Examples of the magenta colorant include a condensed nitrogen compound, an anthraquin compound, a quinacridone compound, a basic dye lake compound, a naphthol compound, a benzimidazole compound, a thioindigo compound, or a perylene compound. For example, C.I. Pigment Red 2, 3, 5, 6, 7, 23, 48:2, 48:3, 48:4, 57:1, 81:1, 144, 146, 166, 169, 177, 184, 185, 202, 206, 220, 221, or 254, and others may be used.

Examples of the cyan colorant include a copper phthalocyanine compound and its derivatives, an anthraquinone compound, or a basic dye lake compound. For example, C.I. Pigment Blue 1, 7, 15, 15:1, 15:2, 15:3, 15:4, 60, 62, or 66, and others may be used.

The colorants may be used alone or as a mixture of two or more. The colorant is selected according to the desired hue, chroma, brightness, weather resistance, dispersion in the toner, and other desirable properties.

The colorant is used in a sufficient concentration to color a toner such that the toner may form a visible image by development. For example, the concentration of the colorant may be about 2-20 parts by weight, based on 100 parts by weight of the binder resin. If the concentration of the colorant is less than 2 parts by weight, sufficient coloring effects cannot be attained. If the concentration of the colorant is greater than 20 parts by weight, an electrical resistance of the toner decreases and sufficient frictional charge cannot be obtained, thus causing contamination.

To ensure a uniform dispersion of the colorant in the binder resin, the colorant may be previously flushing-treated or a melt-kneaded master batch containing a resin and a high concentration of the colorant may be used. For example, the binder resin and the colorant as essential components may be mixed with each other using a kneading means, such as a 2-roll, a 3-roll, a press kneader, or a twin-screw extruder. The colorant must be uniformly dispersed in the mixture and melt-kneading is performed at 80-180° C. for 10 minutes to 2 hours. Then, the mixture is pulverized using a pulverizer, for example, a jet mill, an attritor mill, a rotary mil, or other suitable apparatus to produce the toner particles having an average particle size of about 3-15 μm. The external additive is attached to the toner particles to improve powder mobility, charging stability, and other properties of the toner particles.

The electrophotographic developing agent according to an embodiment of the present invention comprises a charge control agent. The charge control agent may be a negative-charge control agent or a positive-charge control agent. The charge control agent ensures that the toner is stably supported on the developing roller by an electrostatic force, thereby allowing for a stable and rapid charging speed.

Examples of the negative-charge control agent include an organic metal complex, such as a chromium-containing azo dye or a monoazo metal complex, or a chelating compound; a salicylic compound containing metal, such as chromium, iron, or zinc; and an organic metal complex with aromatic hydroxycarboxylic acid or aromatic dicarboxylic acid, but are not limited thereto.

Examples of the positive-charge control agent include a product modified with nigrosine and its fatty acid metal salt, etc., and an onium salt containing a quaternary ammonium salt, such as tributylbenzylammonium 1-hydroxy-4-naphthosulfonate and tetrabutylammonium tetrafluoroborate. The charge control agent may be used alone or as a mixture of two or more charge control agents.

The concentration of the charge control agent in the toner composition may be generally about 0.1-10 parts by weight, based on 100 parts by weight of the parent toner particles.

The electrophotographic developing agent according to an embodiment of the present invention may be used not only in an electrophotographic apparatus using the non-contacting non-magnetic one-component toner, but also in an electrophotographic apparatus using a contacting non-magnetic one-component developing toner. Also, the electrophotographic developing agent may be used in both a negatively charged toner and a positively charged toner.

In conventional polymerized or pulverized toners, a colorant, a charge control agent, a releasing agent, and other components are uniformly incorporated into a binder resin to improve chromaticity, the charging property, and the fusing property of the toner. Also, various types of external additives are added to the toners to increase mobility, the charge stability, and the cleaning property, as well as other properties of the toner. After adding the external additives to the toners, the external additives may be detached from the toners or embedded into the toners, thereby causing deterioration of the images. Thus, at least two types of external additives which have different average particle sizes may be used together to prevent the external additives from being detached from or embedded into the toners.

The external additive used in an embodiment of the present invention may comprise silica particles, titanium oxide, and polymer beads. As the silica particles, two types of silica particles may be used together as a mixture. In one embodiment, the silica particles comprise a mixture of first silica particles having a first particle size and second silica particles having a second particle size where the first and second particles have different particle diameters. The average particle diameters of the first silica particles may be about 30-40 nm and the average particle diameter of the second silica particles may be about 5-8 nm. The large-diameter silica particles that define the first silica particles prevent deterioration of the toner by providing durability as spacer particles and improve a transfer property. The small-diameter silica particles that define the second silica particles mainly impart mobility to the toner.

The respective concentrations of the first silica particles and the second silica particles may be independently about 1-3 parts by weight, based on 100 parts by weight of the parent toner particles. If the concentration is less than 1 part by weight, the effects of adding the silica particles cannot be easily obtained. If the concentration is greater than about 3 parts by weight, the fusing property decreases, excessive charging occurs, and the cleaning property decreases.

The first silica particles and the second silica particles may be surface-treated with an organosilazane and/or polysiloxane. Examples of The organosilazane include hexamethyldisilazane (HMDS). One example of the polysiloxane include a dimethylpolysiloxane (DMPS). A complex surface-treatment may be performed using HMDS and DMPS. When the silica particles subjected to the complex surface-treatment are used as the external additive, a stable charging amount and distribution of the toner may be maintained even though use environments of the toner change and a time-lapse change occurs after an image print for a long time.

When using only silica particles having a relatively large specific surface area, the transfer efficiency may greatly increase, but the drum may be contaminated after a lot of images are printed for a long time. Thus, in addition to the silica particles, other inorganic particulates may be used to significantly improve the transfer efficiency without the contamination of the drum. Materials of the inorganic particulates may be selected from the group consisting of titanium oxides, aluminium oxides, zinc oxides, magnesium oxides, cerium oxides, iron oxides, copper oxides, and tin oxides. Other inorganic particulates can also be used as know in the art. Preferably, titanium oxides may be used.

Titanium oxide may be used to increase mobility of the toner and maintain high transfer efficiency even when a lot of printing is performed. Especially, a charge-up of the toner occurring at a low temperature and a low humidity may be prevented and a charge-down of the toner occurring at a high temperature and a high humidity may be prevented. Titanium oxide may have a primary average particle diameter of about 5-50 nm, preferably about 5-20 nm. If the average particle diameter is greater than 50 nm, the charge-down may occur at a high temperature and a high humidity. If the average particle diameter is less than 5 nm, the fusing property may deteriorate and charge uniformity cannot be attained.

The concentration of the titanium oxide may vary according to the concentrations of the two types of silica. The concentration of the titanium oxide may be about 0.1-0.5 parts by weight, preferably about 0.1-0.3 parts by weight, based on 100 parts by weight of the parent toner particles. If the concentration of the titanium oxide is less than 0.1 parts by weight, charge uniformity of the toner cannot be increased, and thus there is a risk of contaminating non-image portions due to a reverse-charged toner. If the concentration of the titanium oxide is greater than 0.5 parts by weight, the cleaning property may be deteriorated, and thus, there is a risk of contaminating a charging roller and a developing member.

In addition to the above additives, polymer beads may be added to the electrophotographic developing agent according to an embodiment of the present invention. The polymer beads are used to prevent image contamination which is caused by contamination of the developing member. Examples of the polymer beads include melamine-based beads and polymethylmethacrylate (PMMA).

The concentration of the polymer beads may be about 0.1-2.0 parts by weight, based on 100 parts by weight of the parent toner particles. If the concentration of the polymer beads is less than 0.1 parts by weight, the image contamination cannot be prevented. If the concentration of the polymer beads is greater than 2.0 parts by weight, the polymer beads may be easily separated from the toner and aggregated by themselves.

In another embodiment of the present invention, an electrophotographic image forming apparatus using the electrophotographic developing agent is provided.

FIG. 1 is a schematic view illustrating an image forming apparatus using a non-contacting developing mode according to an embodiment of the present invention.

Referring to FIG. 1, a non-magnetic one-component developing agent 8 is fed to a developing roller 5 by a feeding roller 6 made of an elastic material such as a polyurethane foam or sponge. As the developing roller 5 rotates, the developing agent 8 on the developing roller 5 reaches a portion where a developing agent-regulating blade 7 contacts the developing roller 5. The developing agent-regulating blade 7 is made of metal or an elastic material such as rubber. When the developing agent 8 passes through the portion where the developing agent-regulating blade 7 contacts the developing roller 5, a thin layer of the developing agent 8 with a uniform thickness is formed on the developing roller 5 and is sufficiently charged. The thin layer of the developing agent 8 is transferred to a developing region of a latent image support, such as the a photoreceptor 1, wherein the developing agent 8 is developed on an electrostatic latent image formed on the photoreceptor 1.

The developing roller 5 is positioned opposite to the photoreceptor 1 and is separate from the photoreceptor 1 by a predetermined certain interval. The developing roller 5 rotates counterclockwise and the photoreceptor 1 rotates clockwise. The developing agent 8 is transferred to the developing region and is developed on the electrostatic latent image of the photoreceptor 1 by an electric power occurring due to a potential difference between a DC-overlapped AC voltage applied on the developing roller 5 and a potential of the latent image on the photoreceptor 1.

The developing agent 8 is developed on the photoreceptor 1 and reaches a position of a transfer means 9 according to rotation of the photoreceptor 1. When a sheet of a printing paper 13 passes between the photoreceptor 1 and the transfer means 9, the developing agent 8 developed on the photoreceptor 1 is transferred to the printing paper 13 by a corona discharge or a high reverse polar voltage to the developing agent 8, the voltage is applied to the transfer means 9 in a form of a roll, thereby forming an image.

As the printing paper 13 passes through a fusing apparatus (not shown) at high temperature and high pressure, the image transferred to the printing paper 13 is fused on the printing paper 13. An undeveloped toner remaining on the developing roller 5 is recovered by the feeding roller 6 contacting the developing roller 5. The above process is repeated.

Hereinafter, the present invention will be described in more detail with reference to the following examples. However, these examples are for illustrative purposes only and are not intended to limit the scope of the invention.

EXAMPLES

Amounts of substances used below are expressed in "part by weight" based on 100 parts by weight of parent toner particles.

Raw Materials Used

◎ Binder resin: Polyester resins (manufactured by Mitsubishi Rayon Co., Ltd.) were used. Physical properties of the binder resins are listed in Table 1.

TABLE 1

| | High viscosity resin | Low viscosity resin |
|---|---|---|
| $M_w$ | 115,000 | 58,500 |
| $M_n$ | 2,900 | 3,700 |
| $M_w/M_n$ | 39.8 | 20 |
| Gel | 4% | 1.5% |
| AV | 13 | 10 |
| $T_g$ | 62° C. | 62° C. |
| $T_{fb}$ | 95° C. | 95° C. |
| $T_{1/2}$ | 119° C. | 119° C. |

◎ Releasing agent (wax): Carnauba wax (manufactured by TOA KASEI)

Properties=>$T_m$=85-86° C., $T_{1/2}$=85° C.

Figure 2:
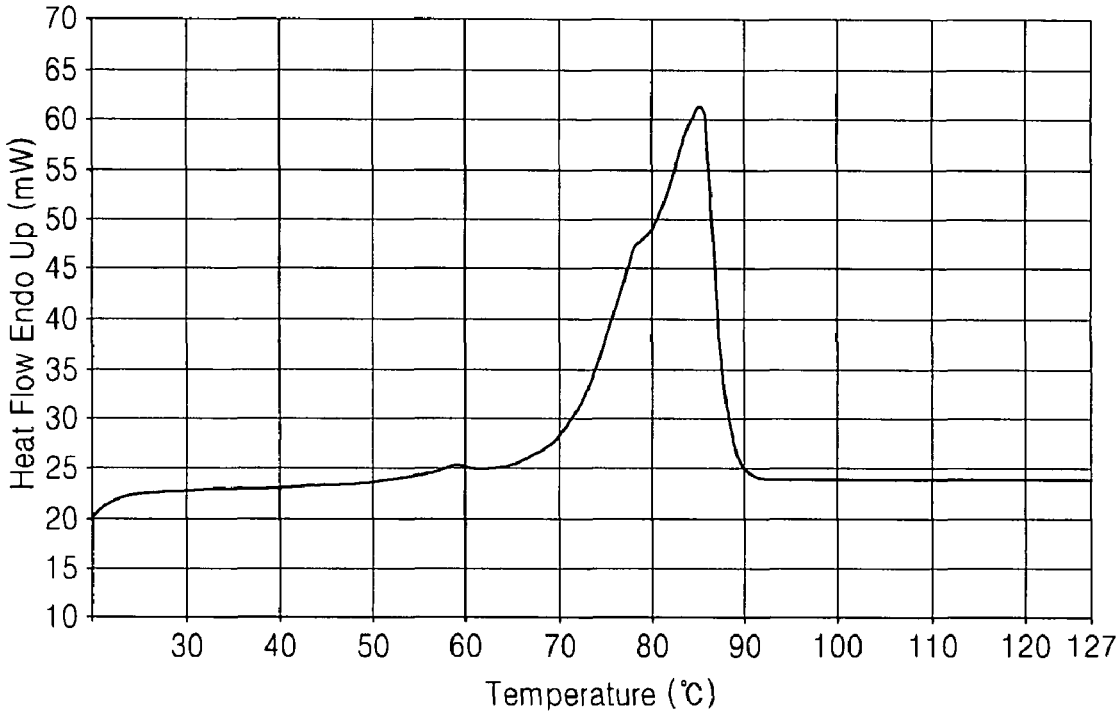
FIG. 2 is a graph illustrating differential scanning calorimetry (DSC) data of a carnauba wax used in the Examples according to an embodiment of the present invention.

FIG. 2 is a graph illustrating differential scanning calorimetry (DSC) data of a carnauba wax used in Examples according to an embodiment of the present invention. Referring to FIG. 2, a melting point of the carnauba wax is 85-86° C.

◎ Colorant

Bk (Black): mogul-L

Y (Yellow): PY 180

M (Magenta): PR 57:1

C (Cyan): PB 15:3

◎ Charge control agent (CCA)

Bk: T-77

C, M, Y: LR147

LR147—chemical formula: $C_{28}H_{20}BO_6.K$

CAS. 114803-11-1 (boro bis(1,1-diphenyl-1-oxo-acetyl) potassium salt)

◎ Concentrations (weight ratios) of internal additives for each color in a whole kneading process are listed in Table 2:

TABLE 2

| | Bk | C | M | Y |
|---|---|---|---|---|
| Binder resin (high viscosity polyester resin + low viscosity polyester resin) | 92 parts by weight | 92 parts by weight | 91 parts by weight | 92 parts by weight |
| Wax | 3 parts by weight | 3 parts by weight | 3 parts by weight | 3 parts by weight |
| Colorant | 3 parts by weight | 2 parts by weight | 4 parts by weight | 3 parts by weight |
| Charge control agent | 2 parts by weight | 2 parts by weight | 2 parts by weight | 2 parts by weight |

Preparation of Toners

<Preparation of Toners without External Additives>

Example 1

92 parts by weight of the high viscosity polyester resin and the low viscosity polyester resin shown in Table 1 (weight ratio 6:4, manufactured by Mitsubishi Rayon Co., Ltd.), 3 parts by weight of a black colorant mogul-L (manufactured by Cabot Corporation), 2 parts by weight of a charge control agent T-77 (manufactured by Hodogaya), and 3 parts by weight of a carnauba wax (manufactured by Toa Kasei Co. Ltd.) were pre-mixed using a Henschel mixer. Then, the resultant mixture was placed into a twin-screw extruder, and melted and extruded at 130° C. The extruded product was cooled to be coagulated, and then, the resultant kneaded intermediate material was pulverized using a mechanical mill (SR-15) and classified using a classifier to obtain an untreated toner having an average particle diameter of about 8 μm.

Example 2

An untreated toner was prepared in the same manner as in Example 1, except that a mixing ratio of the high viscosity polyester resin and the low viscosity polyester resin is 5:5.

Example 3

An untreated toner was prepared in the same manner as in Example 1, except that a mixing ratio of the high viscosity polyester resin and the low viscosity polyester resin is 3:7.

Example 4

An untreated toner was prepared in the same manner as in Example 1, except that a mixing ratio of the high viscosity polyester resin and the low viscosity polyester resin is 15:85.

Example 5

An untreated toner was prepared in the same manner as in Example 1, except that a mixing ratio of the high viscosity polyester resin and the low viscosity polyester resin is 0:100.

<Preparation of Toners with External Additives>

Toners were completed by adding identical external additives to the untreated toners having no external additives, prepared in Examples 1 to 5.

Organic and inorganic external additives were mixed with each of the untreated toners using a Henschel mixer at a line speed of its wing end of 20-30 m/sec for 5 minutes. The used organic and inorganic external additives are listed in Table 3:

TABLE 3

| | First silica particles | Second silica particles | Titanium oxide | Melamine-based bead |
|---|---|---|---|---|
| Materials | $SiO_2$ | $SiO_2$ | $TiO_2$ | Melamine-formaldehyde |
| Particle size | 35 nm | 7 nm | 10 nm | 0.4 nm |
| Surface treatment | Dimethyl-polysiloxane | Hexamethyl-disilazane | — | — |
| Concentration (part by weight) | 1.3 | 1.0 | 0.2 | 0.2 |

Image Estimation Method

Image estimation was performed by measuring a fusing property, gloss, and durability, based on running estimate in conditions of L/L and H/H.

—Printer used for estimation—

Output mode: single pass mode

Process speed: 125 mm/sec

Temperature of a fusing apparatus: 180° C.

<Estimation of Fusing Property>

A fusing property was estimated by measuring a solid image for each color of the printer in a taping mode in conditions of a low temperature and a low humidity (10±1° C./10±2 RH %) and expressed in percentage.

Color was estimated based on a Magenta toner only.

Taping mode: An adhesive tape (Scotch 810, manufactured by 3M Corporation) was attached to a printed image and then, a 500 g pendulum was allowed to go to and from the attached tape three times and the tape was separated from the image at an angle of 180°. A percentage of an image concentration after the separation relative to the initial image concentration was obtained.

<Estimation of Gloss>

Gloss was estimated for CMYK mixed black images (printed images) using a glossi-meter at an angle of 60° in conditions of a low temperature and a low humidity (10±1° C./10±2 RH %)

Gloss was measured for each of right, middle, and left portions of an image after one cycle of fusing (a fused image after one rotation of a fusing apparatus) and an average value was obtained.

Glossi-meter: Micro-TRI-gloss, manufactured by BYK.

<Estimation of Durability>

Durability was estimated by measuring the time at which a solid image loss occurs in conditions of H/H H/H condition: temperature 30-35° C., relative humidity 80-85%

Image: 5% coverage image for each color

Image loss is a type of organoleptic test and refers to a phenomenon that a bottom portion of a solid image becomes thin due to changes of physical properties of a toner (changes of a charging amount and a surface property, decrease of flowability) as a test of lifetime proceeds.

Estimation criteria 2,000 sheets or less have image loss—NG 2,000-4,000 sheets have image loss—Acceptable 4,000 sheets or more do not have image loss—Good Results of Image Estimation Results of image estimation are shown in Table 4.

TABLE 4

| | Fusing property | Gloss | Durability |
|---|---|---|---|
| Example 1 | 55% | 1.7 | Good |
| Example 2 | 62% | 2.5 | Good |
| Example 3 | 74% | 3.6 | Good |
| Example 4 | 85% | 5.7 | Good |
| Example 5 | 92% | 8.5 | Acceptable |

Referring to Table 4, the fusing property increased in t Example 1 to Example 5 as the amount of the high viscosity polyester decreased. Further, as the concentration of the high viscosity polyester resin decreased, the flowability of the toner compositions was improved, and thus surface flatness increased and the gloss values increased. When the gloss values are high, surface smoothness is high and diffused reflection may be prevented, and thus a toner having excellent image gloss may be obtained.

The toners obtained in Examples 1-4 had "Good" durability. However, the toner obtained in Example 5 had "Acceptable" durability, while it had remarkably excellent fusing property and gloss. This indicates that as the concentration of the low viscosity polyester resin increases and the concentration of the high viscosity polyester resin decreases in a direction from Example 1 to Example 5, the fusing property and the gloss are improved, but the durability decreases.

Thus, it can be confirmed from the above Examples that by controlling using a concentration ratio of a high viscosity polyester resin and a low viscosity polyester resin according to a purpose of use, an electrophotographic developing agent having excellent image gloss and fusing property, while ensuring durability may be prepared.

According to the present invention, an electrophotographic developing agent having improved image gloss and fusing property, while ensuring durability may be prepared by using a blended combination of a high viscosity polyester resin and a low viscosity polyester resin.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A non-magnetic one-component electrophotographic developing agent comprising:

parent toner particles comprising a binder resin, a releasing agent, a colorant, and a charge control agent; and an external additive which is added to a surface of the parent toner particles, wherein the binder resin comprises a mixture of about 10-30 wt% of a high viscosity polyester resin having a weight average molecular weight of about 90,000-140,000 and a gel content of less than about 5% and about 70-90 wt% of a low viscosity polyester resin having a weight average molecular weight of about 52,000-65,000 and a gel content of less than about 2%.

2. The electrophotographic developing agent of claim 1, wherein the high viscosity polyester resin has an acid value of about 10-20 mg KOH/g.

3. The electrophotographic developing agent of claim 1, wherein the low viscosity polyester resin has an acid value of about 5-15 mg KOH/g.

4. The electrophotographic developing agent of claim 1, wherein the high viscosity polyester resin has a glass transition temperature ($T_g$) of about 63-65° C.

5. The electrophotographic developing agent of claim 1, wherein the low viscosity polyester resin has a glass transition temperature ($T_g$) of about 61-63° C.

6. The electrophotographic developing agent of claim 1, wherein the high viscosity polyester resin has a polydispersion index ($M_w/M_m$) of about 36-43.

7. The electrophotographic developing agent of claim 1, wherein the low viscosity polyester resin has a polydispersion index ($M_w/M_m$) of about 15-25.

8. The electrophotographic developing agent of claim 1, wherein the releasing agent is a natural carnauba wax having a melting point of about 80-90° C. and the concentration of the natural carnauba wax is about 2-5% by weight based on the weight of the parent toner particles.

9. The electrophotographic developing agent of claim 1, wherein the external additive comprises first silica particles having a first particle diameter and second silica particles having a second particle diameter that is different from the first particle diameter, titanium oxide, and melamine-based beads.

10. The electrophotographic developing agent of claim 9, wherein the external additives comprise about 1-1.6 parts by weight of the first silica particles, about 0.8-1.2 parts by weight of the second silica particles, about 0.1-0.3 parts by weight of the titanium dioxide, and about 0.1-0.3 parts by weight of the melamine-based beads based on 100 parts by weight of the parent toner particles.

11. The electrophotographic developing agent of claim 9, wherein an average particle diameter of the first silica particles is about 30-40 nm and average particle diameter of the second silica particles is about 5-8 nm.

12. The electrophotographic developing agent of claim 9, wherein the first silica particles and the second silica particles are surface-treated with at least one component selected from the group consisting of organosilazane and polysiloxane.

13. The electrophotographic developing agent of claim 12, wherein the organosilazane is hexamethyldisilazane and the polysiloxane is dimethylpolysiloxane.

14. An electrophotographic image forming apparatus using the electrophotographic developing agent of claim 1.

15. The electrophotographic developing agent of claim 1 wherein the binder resin consists essentially of a blend of the high viscosity polyester resin and the low viscosity polyester resin.

16. The electrographic developing agent of claim 1, wherein the high viscosity polyester resin has a weight average molecular weight, a gel content, an acid value and a glass transition temperature that is higher than the corresponding values of the low viscosity polyester resin.

17. The electrophotographic developing agent of claim 1, wherein the high viscosity polyester resin has a number average molecular weight of 2,800-3,000 and the low viscosity polyester resin has a number average molecular weight of about 3,600-3,800.

* * * * *